US005375437A

United States Patent [19]

Dausch et al.

[11] Patent Number: 5,375,437

[45] Date of Patent: Dec. 27, 1994

[54] OUT-OF-BALANCE CONDITION DETECTING SYSTEM WITH LID ACTUATED SWITCHING ASSEMBLY

[75] Inventors: Mark E. Dausch, Latham; Walter Whipple, III, Amsterdam; Vivek V. Badami, Schenectady, all of N.Y.; Dwight W. Jacobus; Thomas R. Payne, both of Louisville, Ky.

[73] Assignee: General Electric Company, Schenectady, N.Y.

[21] Appl. No.: 124,519

[22] Filed: Sep. 20, 1993

[51] Int. Cl.[5] ..... D06F 37/24

[52] U.S. Cl. ..... 68/12.06; 68/12.26; 68/23.3; 192/136; 210/144; 292/DIG. 69

[58] Field of Search ..... 68/12.06, 12.26, 23.1, 68/23.3; 494/82; 292/DIG. 69; 192/136; 210/144; 248/638

[56] References Cited

U.S. PATENT DOCUMENTS

| | | | |
|---|---|---|---|
| 2,899,131 | 8/1959 | Wohler | 210/144 X |
| 3,088,593 | 5/1963 | Stilwell, Jr. | 68/12.06 X |
| 3,145,818 | 8/1964 | Stelli | 192/136 |
| 3,149,212 | 9/1964 | Smith | 200/61.7 |
| 3,227,835 | 1/1966 | Conrath | 200/61.45 |
| 3,298,525 | 1/1967 | Houser | 68/23.1 X |
| 3,318,118 | 5/1967 | Ohlson | 68/23.1 |
| 3,447,686 | 6/1969 | Houser | 210/144 |
| 3,504,777 | 4/1970 | Waugh | 192/136 |
| 3,736,772 | 6/1973 | Baker | 68/12 R |
| 4,098,098 | 7/1978 | Altnau | 68/23 R |
| 4,449,383 | 5/1984 | Cartier | 68/12 R |
| 4,910,502 | 3/1990 | Serveau et al. | 340/683 |
| 5,050,407 | 9/1991 | Wild | 68/12.06 |

FOREIGN PATENT DOCUMENTS

| | | | |
|---|---|---|---|
| 1165497 | 3/1964 | Germany | 68/12.26 |

*Primary Examiner*—Philip R. Coe

*Attorney, Agent, or Firm*—Enrique J. Mora; Paul R. Webb, II

[57] ABSTRACT

An out-of-balance condition detecting system with a lid actuated switching assembly for interrupting operation of a washing machine upon detection of an out-of-balance (OOB) condition or upon a lid of the washing machine being open. The system includes pneumatic generating units for generating a predetermined fluidic pressure in response to excursions of a tub of the washing machine during a spin cycle; an actuator which is fluidly coupled to such generating units for providing an actuating position corresponding to the OOB condition; and a switching assembly which includes a switch responsive to the actuator in its actuating position to interrupt the OOB condition. The switch is further responsive to the lid to deenergize the motor upon the lid being in an open position. The switch which can be either mechanically or magnetically actuated may be designed such that once the OOB condition has been detected, a user is required to open the lid in order to reset operation of the washing machine.

38 Claims, 7 Drawing Sheets

OUT-OF-BALANCE CONDITION DETECTING SYSTEM WITH LID ACTUATED SWITCHING ASSEMBLY

RELATED APPLICATIONS AND PATENTS

This application is related to the application entitled "System and Method for Detecting and Interrupting an Out-of-Balance Condition in a Washing Machine", Ser. No. 08/124,517, (RD-22991) filed concurrently with this application and assigned to the assignee of the present invention, and which is incorporated herein by reference.

BACKGROUND OF THE INVENTION

The present invention is generally related to washing machines and, more particularly, to an out-of-balance condition detecting system for interrupting operation of the washing machine upon detection of an out-of-balance (OOB) condition or upon a lid of the washing machine being open.

In a typical washing machine the OOB condition can occur during a spin cycle when the articles to be cleansed, such as clothing and the like, bunch up asymmetrically at various locations in a washer basket for holding such articles. For various detrimental reasons the OOB condition is not desirable if left uninterrupted. For example, a tub which encloses the basket may violently strike the cabinet of the washing machine and thus cause damage either to the tub, the cabinet or both. Further, unacceptable stress forces can develop during the OOB condition that can affect the suspension mechanism of the washing machine as well as other components thereof such as the transmission or other suitable connecting device which links the motor of the washing machine to the spinning basket.

Some existing electromechanically controlled washing machines incorporate an OOB switch or combination of a lid and OOB switch which in either case deenergize the motor of the washing machine during high speed spin if a single excursion of the outer tub reaches a point where the tub mechanically trips the OOB switch. A drawback of this approach is that although a combination of lid and OOB switch is provided such combination is susceptible to unnecessarily interrupting operation of the washing machine being that a single excursion of the outer tub is sufficient to trip the OOB switch. This is not desirable because the operation of the washing machine can be mistakenly interrupted during situations which do not correspond to an actual OOB condition (i.e., a detrimental or harmful OOB condition) and thus the time required to complete the washing operation increases unnecessarily. For example, as the basket gradually increases its spin speed from a no spin state up to its specified operating spin speed, it is typical to encounter certain natural mechanical frequencies which can induce brief or momentary excursions of the tub. However, such brief or momentary excursions which do not correspond to the actual OOB condition can be sufficient to trip the OOB switch and thus this approach is prone to error being that a single excursion of the tub is all that is required to mechanically trip the OOB switch.

Other washing machines which incorporate a respective microprocessor to provide electronic control of the washing operation can detect the OOB condition and take suitable corrective action to interrupt the OOB condition. However, the OOB detection technique utilized in this approach is implemented through the use of elaborate logic which cooperates with the controlling microprocessor or other such electronic device to detect the OOB condition and thus implementation of this technique which requires use of such elaborate logic adds to the complexity as well as to the cost of the washing machine.

It is therefore an object of the present invention to provide an improved out-of-balance condition detecting system capable of interrupting operation of the washing machine upon detection of the OOB condition or upon the lid of the washing machine being open wherein such system is substantially impervious to detecting erroneous OOB conditions.

It is another object of the present invention to provide an out-of-balance condition detecting system which can be conveniently used either in electronically or electromechanically controlled washing machines.

It is yet another object of the present invention to provide an out-of-balance condition detecting system having a lid actuated switching assembly for resetting operation of the washing machine subsequent to detection of an actual OOB condition.

SUMMARY OF THE INVENTION

The foregoing and further objects of the present invention will become apparent as the description proceeds. In accordance with the present invention, an out-of-balance condition detecting system is provided for interrupting a motor in a washing machine which normally rotates a washer basket about a predetermined spin axis during a spin cycle. The foregoing interruption occurs upon the system detecting an OOB condition or upon a lid of the washing machine being open. The OOB condition can be characterized by excursions of a tub which encloses the washer basket. The tub excursions can be in a direction generally parallel to the spin axis of the washer basket, for example. The system comprises means for generating a fluidic pressure in response to excursions of the tub. An example of a fluid that can be conveniently used to develop such fluidic pressure is air.

An actuator is fluidly coupled to the generating means and the actuator is responsive to a predetermined level of fluidic pressure for providing an actuating position corresponding to the out-of-balance condition. The actuator comprises a respective enclosure supported in the cabinet of the washing machine. In one embodiment of the invention, the actuator further comprises biasing means and an actuating piston having an actuating rod which cooperate in their respective enclosure such that the actuating rod moves in response to the predetermined level of the fluidic pressure from a nonactuating position to reach the actuating position and moves back to the nonactuating position absent the predetermined level of the fluidic pressure upon interruption of the out-of-balance-condition.

A switching assembly includes a switch responsive to the actuator in its actuating position to deenergize the motor upon detection of the OOB condition. The switch is further responsive to the lid to deenergize the motor upon the lid being in an open position. In this one embodiment of the invention, the switching assembly comprises a housing responsive to the actuating rod and adapted to move in response to the actuating rod from a first position corresponding to a balanced condition to a second position corresponding to the OOB condition.

The housing can be operatively coupled to a respective spring or other similar biasing device for predeterminedly biasing such housing with respect to the actuating rod. By way of example, such spring can have its respective opposite ends connected to the housing and the actuating rod respectively. In this one embodiment, the switch includes a respective plunger which is depressed to an energizing position by a respective lid projection whenever the housing is in its first position and the lid is in a closed position thereby energizing the motor. The plunger is released to a deenergizing position whenever the housing moves in response to the actuating rod from its first position to its second position thereby interrupting the out-of-balance condition. The plunger is also released to its deenergizing position whenever the lid is open while the housing is in its first position. The projection of the lid is positioned to impede movement of the housing from its second position to its first position whenever the lid is in the closed position. The spring, which for example, couples the housing to the actuating rod or similarly responsive biasing device cooperates to return the housing from its second position to its first position upon the lid being open and upon the actuating rod having returned to its nonactuating position absent sufficient fluidic pressure to maintain its actuating position.

In another embodiment of the invention the switch can be a magnetically actuated switch such as a magnetic reed switch, for example, which responds to the magnetic field produced by a lid magnet positioned to actuate the switch to a respective deenergizing position upon the lid being open. In this embodiment the actuating piston can include a respective magnet which cooperates with the lid magnet to actuate the switch to a respective deenergizing position whenever the actuating piston reaches its respective actuating position and the lid is in its closed position. Alternatively, the actuating piston may be constituted of suitable magnetic material. In this manner, a washing machine can be provided with the foregoing system having a lid actuated switching assembly for interrupting operation of the washing machine upon detection of the out-of-balance condition or upon the lid of the washing machine being open.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following detailed description in conjunction with the accompanying drawings in which like numerals represent like parts throughout the drawings, and in which:

Figure 1:
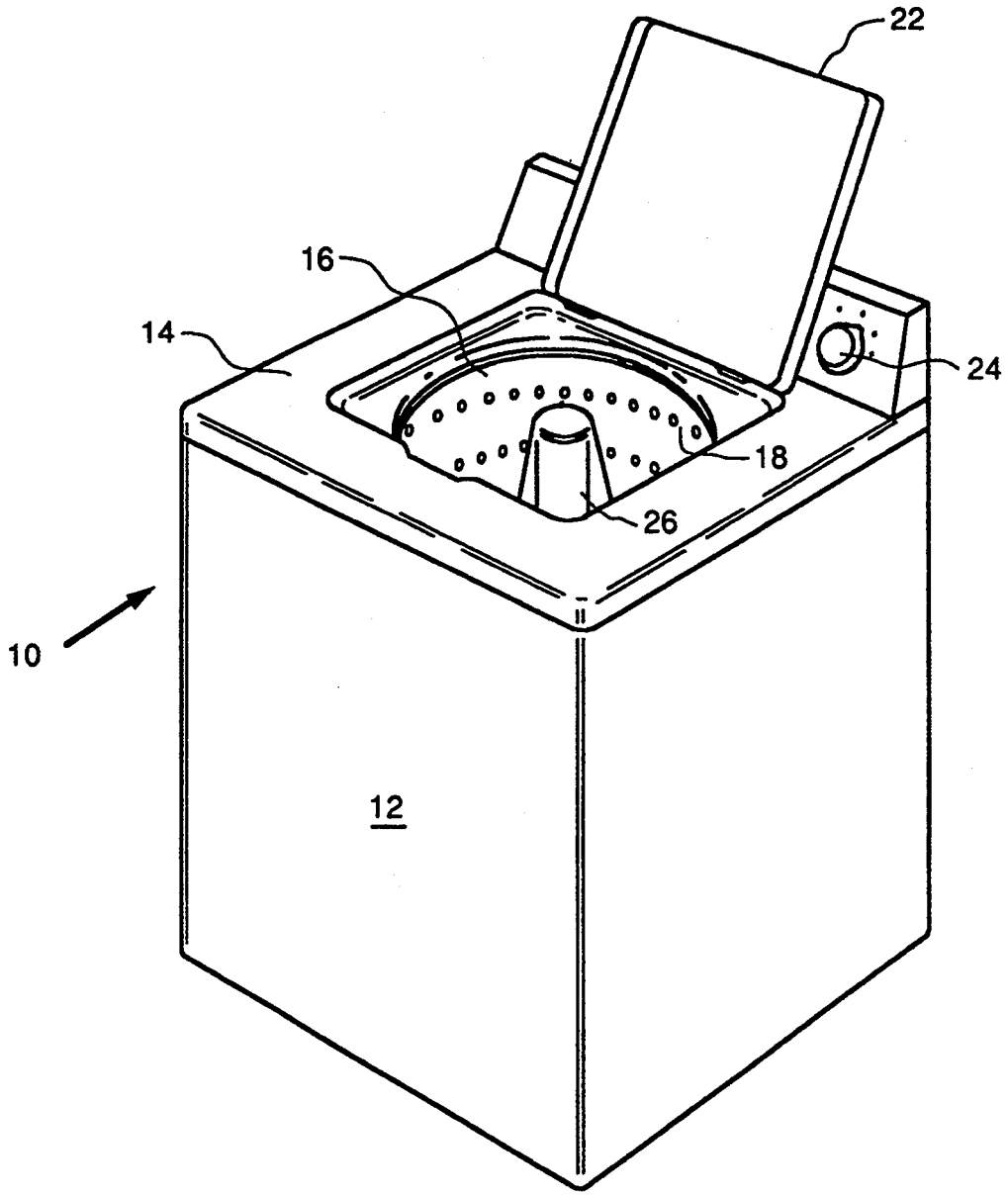
FIG. 1 is a perspective view of a top-loading washing machine.
Figure 5:
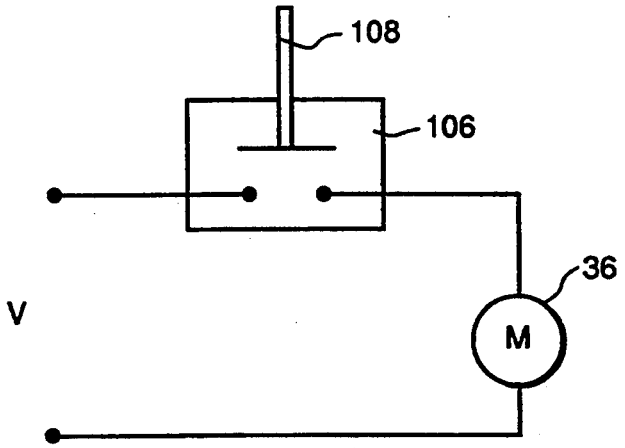

FIG. *2a* is a simplified schematic representation illustrating an exemplary suspension for the washing machine shown in FIG. 1;

FIG. *2b* illustrates the representation of FIG. *2a* during an out-of-balance condition;

FIGS. *3a, 3b* and *3c* illustrate respective schematic elevation views of a washing machine incorporating one exemplary embodiment of a system showing respective operational aspects of an exemplary actuator and a switching assembly actuated therewith or with a lid of the washing machine in accordance with the present invention;

FIGS. *4a* and *4b* illustrate respective schematic views of another embodiment which uses an exemplary magnetic actuator shown in its nonactuating and actuating positions, respectively, and a magnetically actuated switch in accordance with this embodiment of the present invention; and FIG. 5 is a schematic diagram illustrating one exemplary mechanically actuated switch connected between a suitable electrical power source and the motor of the washing machine.

DETAILED DESCRIPTION OF THE INVENTION

FIG. 1 illustrates a top loading washing machine 10 which has a cabinet 12 having a respective top panel 14 with an access opening 16 for loading and unloading articles to be cleansed in a washer basket 18. In a conventional washing operation, the articles to be cleansed are loaded through access opening 16 into basket 18, and after lid 22 is closed and a control knob 24 or other suitable control device is properly set, the washing machine sequences trough a predetermined sequence of cycles such as wash, rinse and spin cycles. An agitator 26 is generally positioned in basket 18 to agitate or scrub the articles to be cleansed during the wash and rinse cycles, for example.

FIG. *2a* shows a simplified schematic representation illustrating an exemplary suspension 28 used in washing machine 10 to provide mechanical isolation and support with respect to cabinet 12 of components such as washer basket 18, a tub 34, a motor 36 and a transmission 38. Suspension 28 typically comprises connecting rods 30 and springs 32 suitably selected in accordance with the particular mechanical characteristics of a given washing machine. During the wash and rinse cycles, tub 34 is filled with water and agitator 26 (not shown in FIGS. *2a* and *2b*) is driven back and forth by motor 36 respectively linked to agitator 26 and basket 18 by transmission 38, for example.

FIG. *2b* illustrates a condition herein referred to as out-of-balance (OOB) condition which can arise during a spin cycle, as basket 18 is rotated about its spin axis by motor 36 at a relatively high spin speed to extract moisture from articles 40. The OOB condition for purposes of illustration can be characterized in terms of excursions of tub 34 in a direction generally parallel to the spin axis during the spin cycle, for example. In the case of a top-loading washing machine, such spin axis may be generally situated in a substantially vertical plane whereas in a front-loading washing machine such spin axis may be generally situated in a substantially horizontal plane. As seen in FIG. *2b* in the context of a top-loading washing machine, articles 40 may asymmetrically bunch up at various height locations in spinning basket 18 and due to the resulting load unbalance in combination with the centrifugal force generated during the spin cycle, the tub 34 may oscillate uncontrollably so as to strike cabinet 12 as well as to impose undue stress force on various components of the washing machine such as the transmission, suspension and other such washing machine components. It should be appreciated that the foregoing OOB condition can develop regardless of the specific orientation of the spin axis of the washer basket and thus the system of the present invention can be effectively used in either top or front-loading washing machines.

Figure 3A:
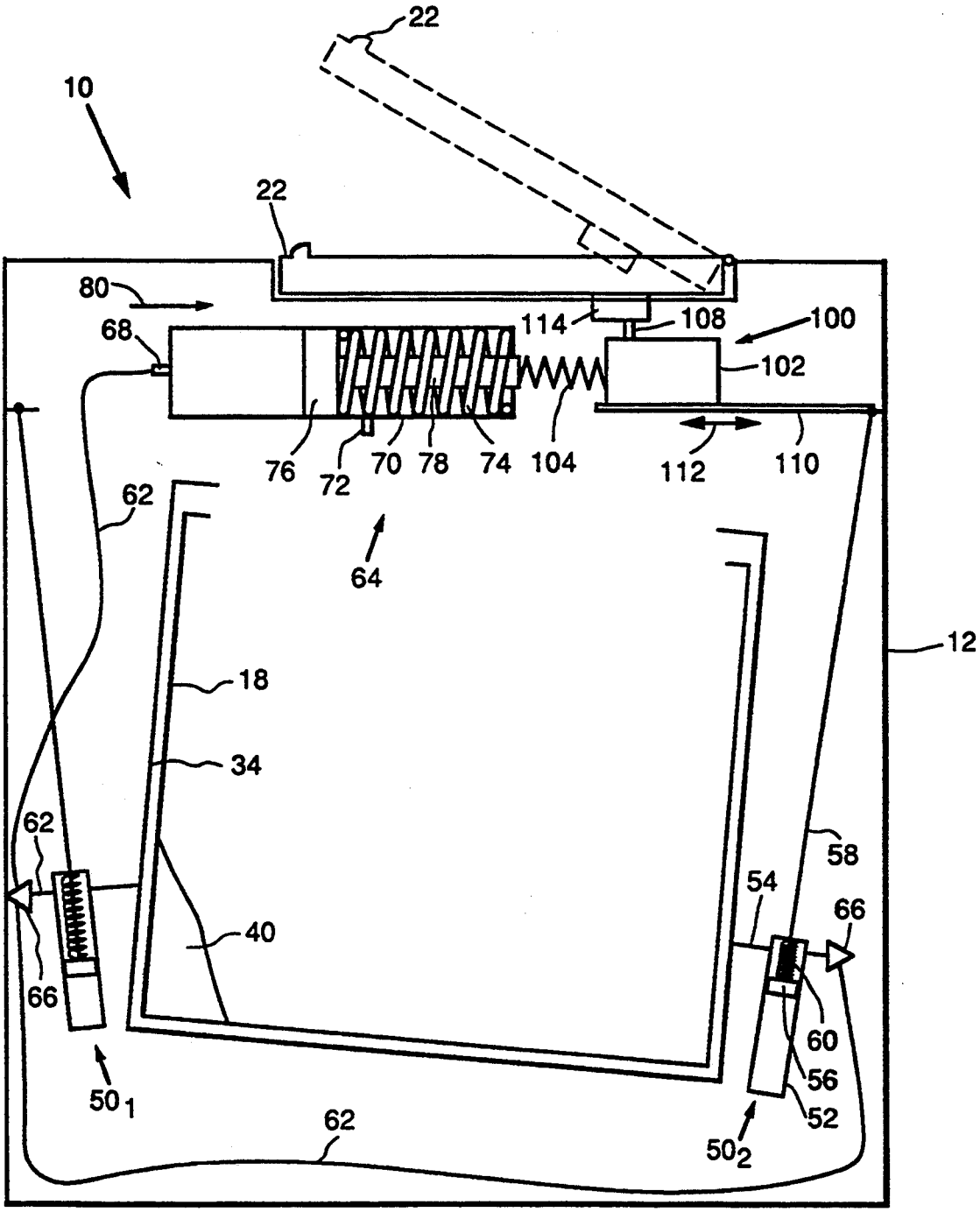
Figure 3B:
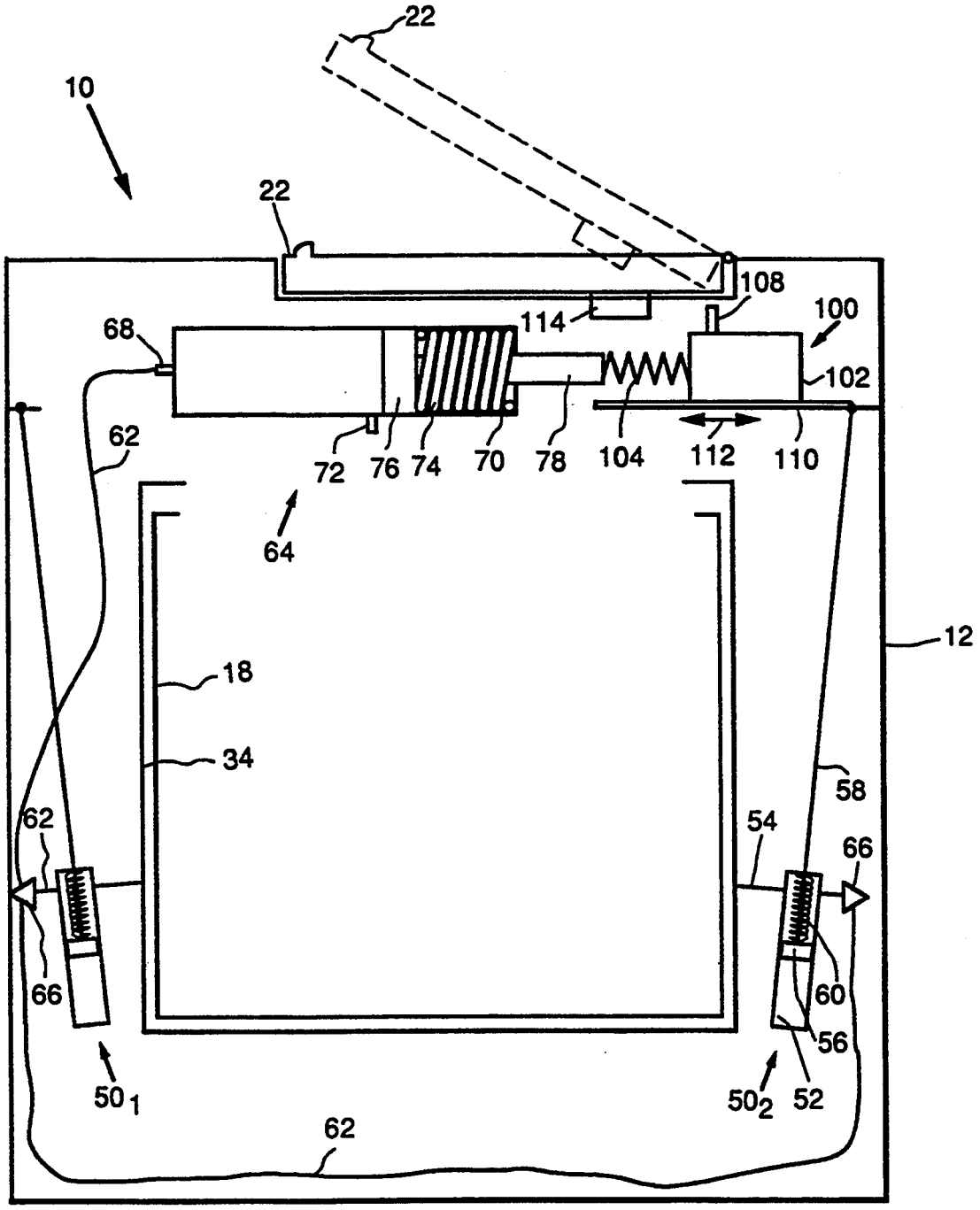
Figure 3C:
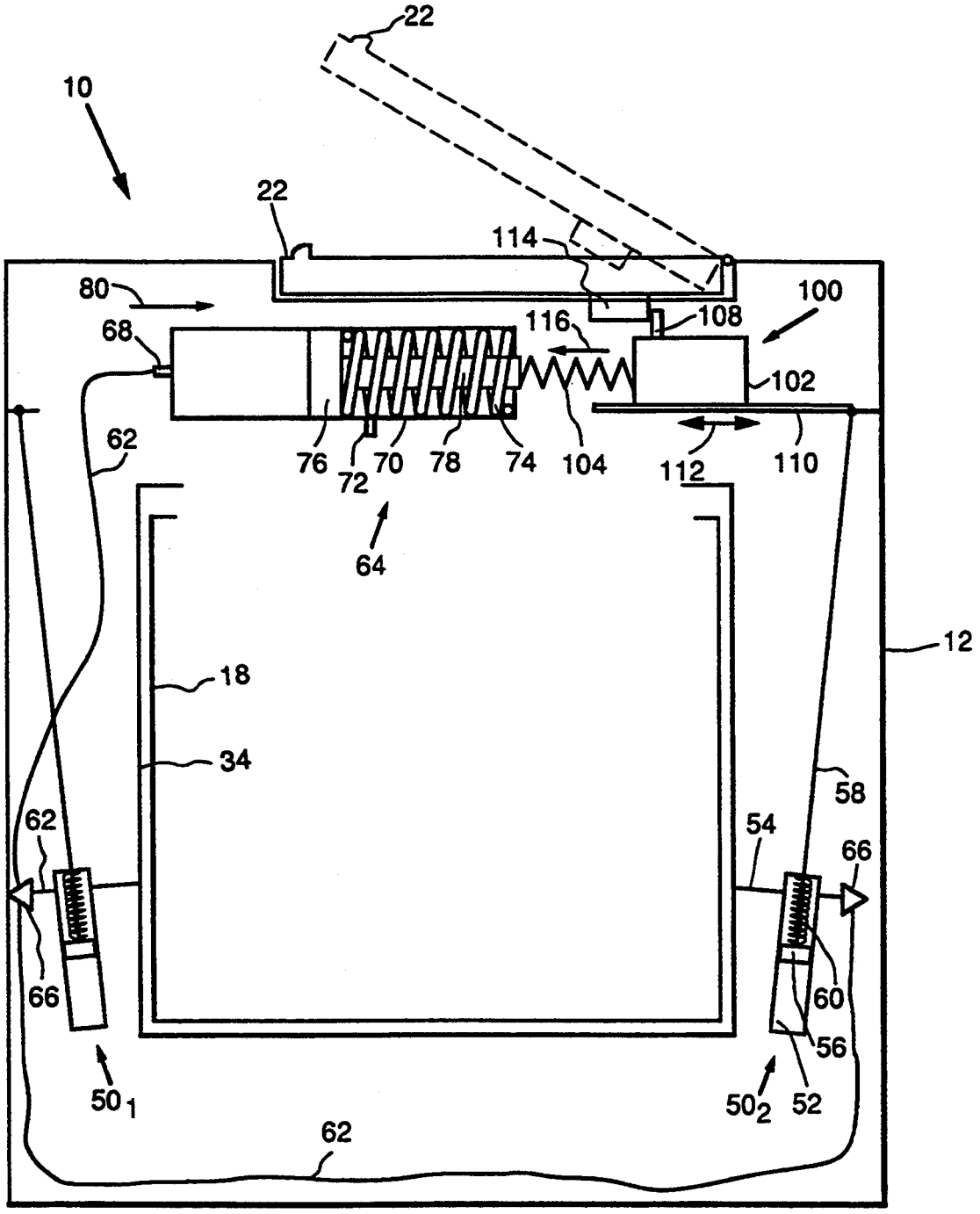

FIGS. *3a, 3b* and *3c* each shows a simplified schematic elevation view of a washing machine 10 which incorporates one exemplary embodiment of an OOB condition detecting system for interrupting the motor upon detection of the OOB condition or upon the lid of the washing machine being open upon action by a user of the washing machine. The system comprises means for generating a fluidic pressure in response to excursions of the tub. The generating means may include one or more respective generating units such as generating units $50_1$ and $50_2$. Only two such generating units are illustrated in FIGS. 3*a*, 3*b* and 3*c* for simplicity of illustration. Preferably, the constituent fluid for developing the fluidic pressure is air, however, other gases or other suitable liquid fluid agent can be equally effective to develop such fluidic pressure. Further, those skilled in the an will appreciate that although the invention is described with reference to a positive fluidic pressure relative to atmospheric pressure, as herein used the term fluidic pressure is not limited to such positive pressure since fluidic pressures below atmospheric pressure can be used equally effective in the implementation of the present invention.

Figure 2A:
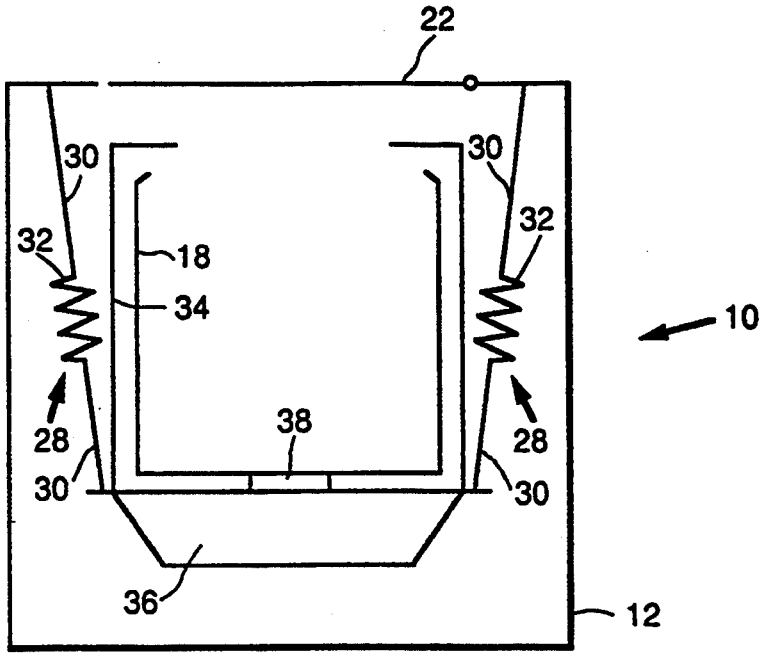
Figure 2B:
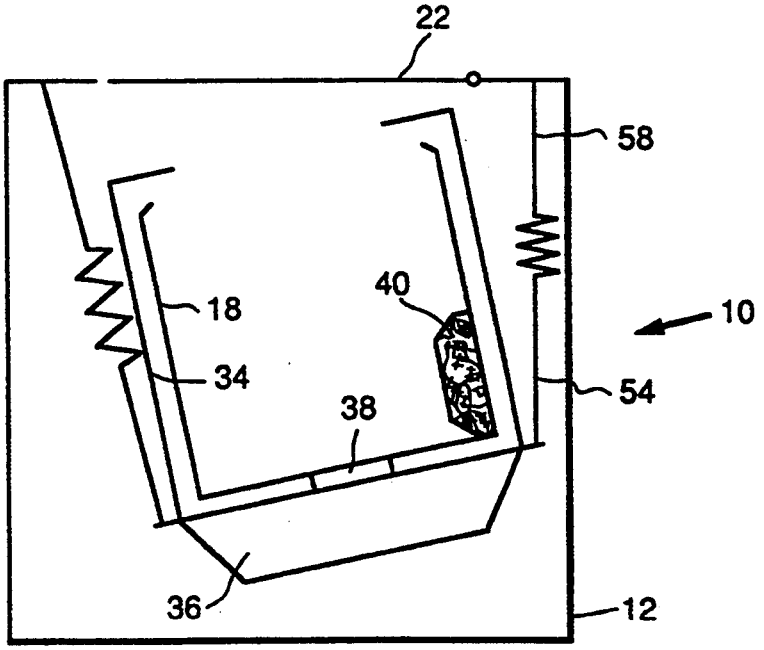

As shown in FIGS. 3*a*, 3*b* and 3*c* each generating unit $50_1$ and $50_2$ comprises a respective cylinder 52 having an extension 54 connected to tub 34 or suitable support structure thereof, and a generating piston 56 having a respective extension 58 connected, by way of example and not a limitation, to cabinet 12 or suitable support structure thereof. An added functional benefit of the generating units can be further obtained if respective pairs, such as generating units $50_1$ and $50_2$, are positioned in spaced relationship to one another oriented by way of example and not of limitation at a suitable angle with respect to one another in a respective plane substantially parallel relative to the spin axis of basket 18. Depending on the specific orientation of the spin axis of the washer basket, such plane can be situated either substantially horizontal or vertical so as to maintain such substantially parallel relationship with respect to the spin axis of the washer basket. In each case, a suspension spring 60 can be incorporated in cylinder 52 such that each generating piston 56 and associated suspension spring 60 can cooperate with one another to effectively support tub 34 with respect to cabinet 12. Thus, the added functional benefit is that the generating units in effect can conveniently become part of the suspension system 28 illustrated in FIGS. 2*a* and 2*b*. The suspension spring can be suitably chosen such that, for example, up and down movement induced by the OOB condition causes cylinder 52 and generating piston 56 of a respective generating unit to reciprocate relative to one another thereby generating the fluidic pressure.

In essence, each generating unit functions as a pneumatic generator having preselected parameters such as a respective time constant and pneumatic gain chosen such that each generating unit supplies its respective contribution to the overall fluidic pressure developed in response to the OOB condition. The use of pneumatics to sense the OOB condition advantageously provides a unique manner of detecting an actual OOB condition, as opposed to detecting a single excursion of the tub which, as previously explained, can cause mistaken interruption of the washing operation.

It will be understood that other design implementations will be equally effective so long as the excursions of the tub due to the OOB condition result in reciprocating action of the generating piston relative to its respective cylinder so as to generate the fluidic pressure within the cylinder. For example, as disclosed in the foregoing incorporated by reference patent application (RD-22991), generating units $50_1$ and $50_2$ may be arranged in a respective substantially perpendicular plane relative to the spin axis of the washer basket so as to be responsive, for example, to excursions of tub 34 in a direction generally perpendicular to the spin axis of the washer basket during the spin cycle. This spatial arrangement can utilize the pneumatic forces developed in such generating units to provide substantially symmetric mechanical damping to tub 34 and hence reduce the magnitude of lateral excursions of tub 34 during the OOB condition or other transitory conditions as may be encountered while spinning up or down basket 18. Alternatively, respective combinations of either of such geometric arrangements for the generating units can effectively provide the fluidic pressure in response to the OOB condition.

A respective conduit 62 such as a hose or the like may be conveniently used to transmit the fluidic pressure from each generating unit to an actuator 64 which can be suitably supported by the cabinet of the washing machine and is shown in FIGS. 3*a*, 3*b* and 3*c* in nonactuating, actuating and nonactuating positions, respectively. To insure that the fluidic pressure increases monotonically during the OOB condition, unidirectional pneumatic valves 66 can be installed along conduit 62. Further, a bleed valve or suitable fluid escape device (not shown) can be provided along conduit 62 for bleeding off the constituent fluid such as pressurized air and thus removing the fluidic pressure upon interruption of the out-of-balance condition. The bleed valve also conveniently provides a way to bleed off transient fluidic pressure buildup which may occur during conditions which do not correspond to the actual OOB condition. For example, as the washer basket spins up or down, it is typical to encounter certain natural mechanical frequencies which can induce brief or momentary excursions of the tub.

Actuator 64 is fluidly coupled to each generating unit $50_1$ and $50_2$ and is responsive to a predetermined level of the fluidic pressure received through an inlet 68 in its respective enclosure 70 for providing an actuating position corresponding to the out-of-balance condition as shown in FIG. 3*b*. To prevent excessive fluidic pressure buildup within enclosure 70 during the OOB condition, a safety valve 72 may be provided in enclosure 70, for example.

By way of example, actuator 64 includes biasing means such as a spring 74 and an actuating piston 76 having a respective actuating rod 78 which cooperate so that actuating rod 78 moves in response to the predetermined level of the fluidic pressure from a nonactuating position illustrated in FIG. 3*a* in the direction indicated by arrow 80 to reach the actuating position shown in FIG. 3*b* and moves back to the nonactuating position as best seen in FIG. 3*c* absent the level of fluidic pressure required to counteract the opposing spring force produced by spring 74. Spring 74 can be connected between a predetermined face of actuating piston 76 and an opposite facing end of the enclosure.

In the embodiment shown in FIGS. 3*a*, 3*b* and 3*c*, a switching assembly 100 comprises a respective housing 102 which by way of example and not of limitation can be coupled to the actuating rod by means of a respective spring 104 that can predeterminedly bias housing 102 with respect to the actuating rod. Depending upon the specific design, housing 102, for instance, could be directly responsive to actuating rod 78, thus obviating such spring coupling. Switching assembly 100 includes a switch 106, best seen in FIG. 5, having a respective suitably biased plunger 108. The housing is adapted to move in response to the actuating rod from a first position illustrated in FIG. 3*a* which corresponds to a balanced condition (i.e., an ordinary operating condition) to a second position which corresponds to the OOB condition illustrated in FIG. 3*b*. Housing 102 may be conveniently mounted on guiding rails 110, for example, or other convenient guiding channel which allows housing 102 to slide in respective opposite directions depicted by double headed arrow 112. In this embodiment, lid 22 preferably includes a projection 114 which is positioned to depress plunger 108 to an energizing position which energizes motor 36 (not shown in FIGS. 3*a* and 3*b*) whenever housing 102 is in its first position as seen in FIG. 3*a* and the lid is in a closed position indicated by the solid line lid 22.

Plunger 108 is released to a deenergizing position whenever housing 102 moves from the first position to the second position illustrated in FIG. 3*b*. This deenergizing position effectively disables motor 36 and thus interrupts the OOB condition. Plunger 108 is also released to such deenergizing position whenever the lid is open and housing 102 is in its first position as shown in FIG. 3*a*. During the OOB condition, actuating rod 78 is responsive to the predetermined level of fluidic pressure so as to move housing 102 either directly or in cooperation with spring 104 from its first position to its second position. Subsequent to interruption of the OOB condition, such fluidic pressure is gradually bled off so that actuating rod 78 gradually returns to its nonactuating position.

As best seen in FIG. 3c, once actuating rod 78 returns to its nonactuating position, spring 104 cooperates to produce a pulling force, represented by single arrow 116 in FIG. 3*c* which would normally return housing 102 to its first position; however, projection 114 is suitably positioned so that the projection interferes with the upper portion of the released plunger. It should be appreciated that other biasing implementations can cooperate to return housing 102 to its first position. For instance a suitable biasing mechanism could be situated so as to produce a pushing force with respect to housing 102. This aspect of the invention effectively impedes housing 102 from returning to its first position whenever the lid is closed, that is, projection 114 extends sufficiently into the path of the released plunger so as to impede movement of housing 102 back to the first position. Thus, in accordance with this aspect of the invention, as long as housing 102 is prevented by projection 114 from returning to its first position, operation of the washing machine cannot resume.

This is desirable because in this manner, the user of the washing machine is unable to restart the washing machine without first opening the lid and hopefully rearranging the unbalanced load which created the out-of-balance condition. Therefore, to return housing 102 to its first position, spring 104 or other similarly responsive biasing device cooperates to return the housing to such first position only upon the lid being open and upon the actuating rod returning to its nonactuating position absent the fluidic pressure in the actuator. This aspect of the invention provides to the user of the washing machine a convenient way to prevent motor turn on once the OOB condition has been detected since the user is required to open the lid in order to reset or resume operation of the washing machine. A convenient indication may be displayed on a suitable display panel (not shown) so as to inform the operator that the spin cycle was interrupted due to the OOB condition and thus after the user opens the lid such user can easily take corrective action to rearrange the articles in the washer basket.

Figure 4A:
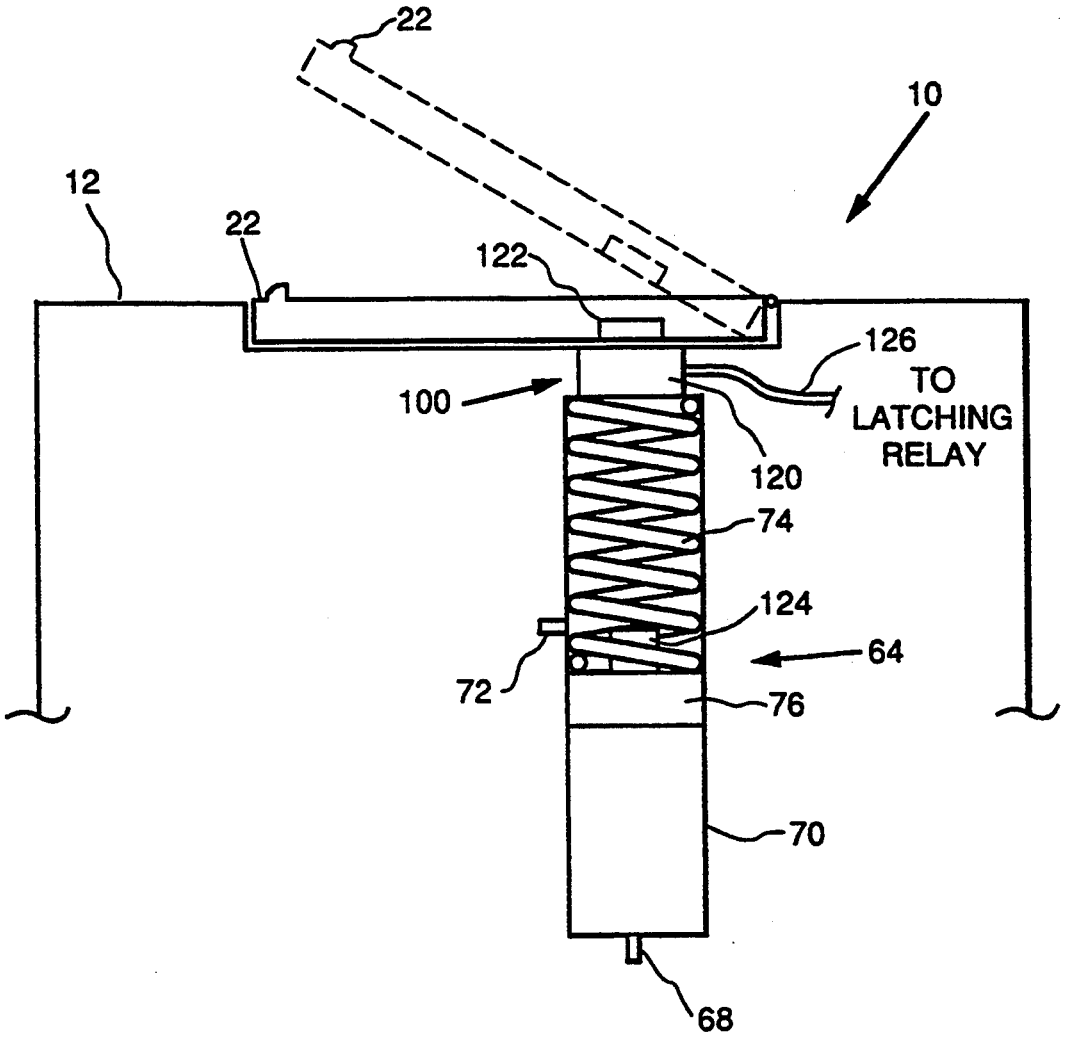
Figure 4B:
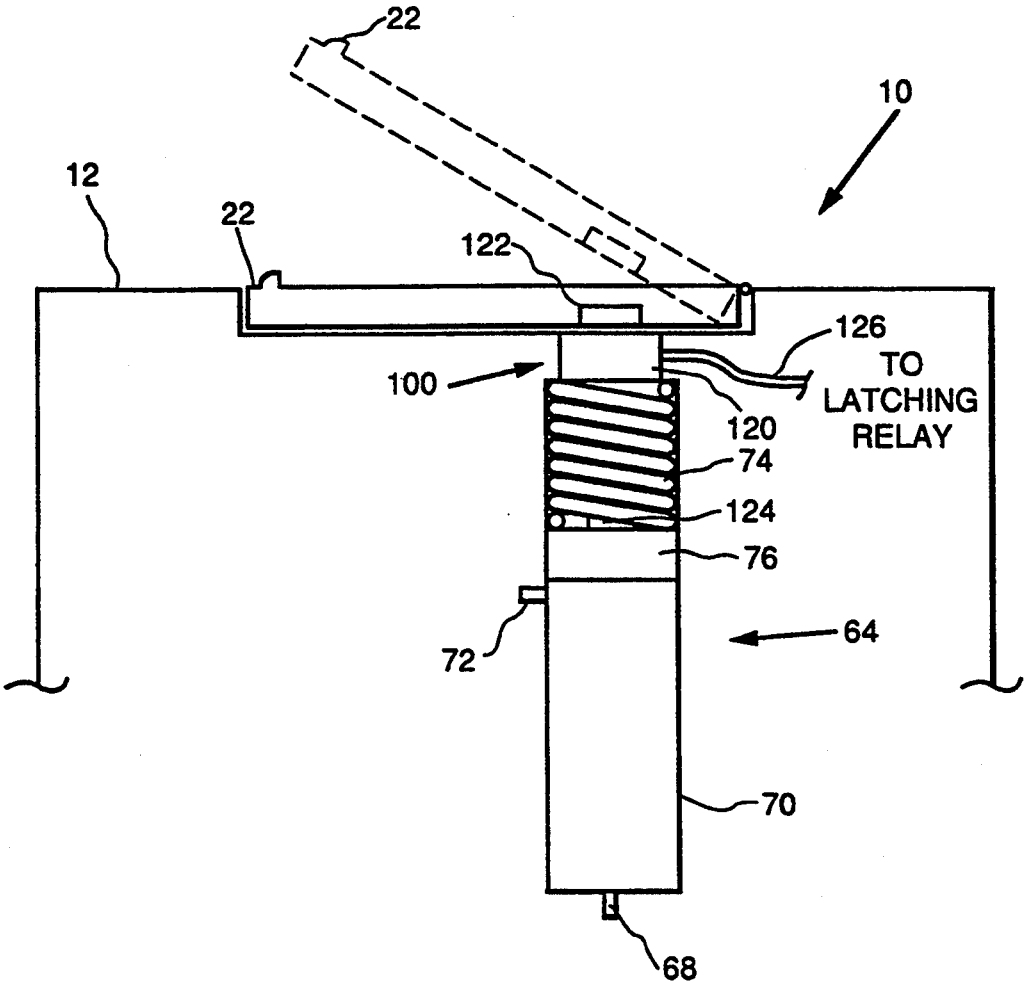

FIGS. 4*a* and 4*b* respectively illustrate another embodiment of the invention wherein switching assembly 100 which in this case can be fixedly secured in cabinet 12 comprises a magnetically actuated switch 120 such as a magnetic reed switch or a Hall effect switch, for example. In this particular embodiment lid 22 includes a respective lid magnet 122 positioned to actuate switch 120 to a respective energizing position upon the lid being closed, as represented by the solid line lid. The actuating piston of actuator 64 will preferably include a respective magnet 124 or may be comprised of suitable, magnetic material which cooperates with the lid magnet to actuate the switch to a respective deenergizing position whenever piston 76 is in its respective actuating position as shown in FIG. 4*b* and the lid is in its closed position. For example, whenever piston 76 is in its actuating position and the lid is closed, lid magnet 122 and actuator magnet 124 may be suitably selected so that their respective magnetic fields cancel one another and thus force switch 120 to its deenergizing position upon detection of the OOB condition. An electrical lead 126 of switch 120 can be connected to a latching relay (not shown), for example, or other such suitable electronic device to prevent the washing machine from restarting when the piston retracts, as air bleeds out of its respective enclosure 70, to its nonactuating position shown in FIG. 4*a*. In this manner, once the OOB condition has been interrupted the user can readjust the positioning of articles in the basket and after closing the lid restart the washing machine by depressing a suitable start button or the like.

FIG. 5 illustrates a simplified schematic showing an exemplary mechanically actuated switch 106 with plunger 108 which as described in the context of FIGS. 3*a*, 3*b* and 3*c* is actuated to deenergize motor 36, i.e., electrically disconnect motor 36 directly or indirectly from a suitable power supply represented by the letter (V) upon detection of the OOB condition or upon the lid of the washing machine being open.

As described, the present invention in either of its exemplary embodiments can be easily incorporated to provide a washing machine having an out-of-balance detecting system for interrupting operation of the washing machine upon detection of the OOB condition and upon a lid of the washing machine being open and wherein the system due to its pneumatic generating units is substantially impervious to detecting erroneous OOB conditions.

It will be readily understood by those skilled in the art that the present invention is not limited to the specific embodiments described and illustrated herein. Many variations, modifications and equivalent arrangements will now be apparent by the foregoing specification and drawings, without departing from the substance or scope of the invention. Accordingly, it is intended that the invention be limited only by the spirit and scope of the appended claims.

What is claimed is:

1. In a washing machine having a tub inside a cabinet with a lid wherein said tub encloses a washer basket for holding articles to be cleansed and wherein the washing machine further includes means for spinning said basket about a predetermined spin axis during a spin cycle, an out-of-balance condition detecting system for interrupting said spinning means upon detecting an out-of-balance condition characterized by excursions of said tub in a direction generally parallel to said spin axis during said spin cycle or upon said lid being open, said system comprising:

means for generating a fluidic pressure in response to said excursions of said tub;

actuating means fluidly coupled to said generating means and responsive to a predetermined level of said fluidic pressure for providing an actuating position corresponding to said out-of-balance condition, said actuating means comprising a respective enclosure in said cabinet, said actuating means further comprising biasing means and an actuating piston having an actuating rod cooperating in said enclosure such that said actuating rod moves in response to said predetermined level of fluidic pressure from a nonactuating position to reach said actuating position and moves back to said nonactuating position absent said predetermined level of fluidic pressure; and a switching assembly including a switch responsive to said actuating means to deenergize said spinning means upon said actuating means being in said actuating position and said switch being further responsive to said lid to deenergize said spinning means upon said lid being in an open position.

2. A system in accordance with claim 1 wherein a constituent fluid for said fluidic pressure is air.

3. A system in accordance with claim 1 wherein said switching assembly comprises a housing responsive to said actuating rod, said housing being adapted to move in response to said actuating rod from a first position corresponding to a balanced condition to a second position corresponding to said out-of-balance condition.

4. A system in accordance with claim 3 wherein said housing is supported on guiding means for permitting slidable movement of said housing between said first and second positions.

5. A system in accordance with claim 4 further comprising respective biasing means operatively coupled to said housing for predeterminedly biasing said housing with respect to said actuating rod.

6. A system in accordance with claim 5 wherein said switch includes a respective plunger.

7. A system in accordance with claim 6 wherein said lid includes a projection positioned to depress said plunger to an energizing position whenever said housing is in said first position and said lid is in a closed position thereby energizing said spinning means.

8. A system in accordance with claim 7 wherein said plunger is released to a deenergizing position whenever said housing moves from said first position to said second position thereby interrupting said out-of-balance condition.

9. A system in accordance with claim 8 wherein said plunger is released to said deenergizing position whenever said lid is open while said housing is in said first position thereby deenergizing said spinning means.

10. A system in accordance with claim 9 wherein said projection is positioned to impede movement of said housing from said second position to said first position whenever said lid is in said closed position.

11. A system in accordance with claim 10 wherein said biasing means operatively coupled to said housing is a spring cooperating to move said housing from said second position to said first position upon said lid being open and upon said actuating rod returning to its nonactuating position absent said predetermined level of fluidic pressure.

12. A system in accordance with claim 11 wherein respective opposite ends of said spring are connected to said housing and to said actuating rod respectively.

13. A system in accordance with claim 2 wherein said switch is a magnetically actuated switch selected from the group consisting of a magnetic reed switch and a Hall effect switch.

14. A system in accordance with claim 13 wherein said lid includes a respective lid magnet positioned to actuate said switch to a respective deenergizing position upon said lid being open thereby disabling said spinning means.

15. A system in accordance with claim 14 wherein said actuating means comprises a respective enclosure in said cabinet, said actuating means further comprising biasing means and an actuating piston cooperating in said enclosure such that said actuating piston moves in response to said predetermined level of fluidic pressure from a nonactuating position to reach said actuating position and moves back to said nonactuating position absent said predetermined level of fluidic pressure.

16. A system in accordance with claim 15 wherein said actuating piston includes a respective magnet disposed in one face of said actuating piston cooperating with said lid magnet to actuate said switch to a respective deenergizing position whenever said actuating piston is in its respective actuating position and said lid is in a closed position thereby interrupting said out-of-balance condition.

17. A system in accordance with claim 1 wherein said generating means comprises a cylinder connected to said tub, said generating means further comprising a generating piston having an extension thereof connected to said cabinet, said generating piston and said cylinder reciprocating relative to one another in response to said excursions of said tub and constituting one generating unit to produce said fluidic pressure.

18. A system in accordance with claim 17 wherein said one generating unit includes a suspension spring cooperating in said cylinder to provide support to said tub with respect to said cabinet.

19. A system in accordance with claim 18 wherein said generating means comprises additional generating units substantially similar to said one generating unit, said additional generating units and said one generating unit being mutually spaced with respect to each other in a respective plane situated substantially parallel relative to the spin axis of said washer basket.

20. A washing machine comprising:

a cabinet having a lid;

a tub being inside said cabinet;

a washer basket for holding articles to be cleansed, said basket being positioned in said tub;

means for rotating said washer basket about a predetermined spin axis during a spin cycle;

said tub being susceptible to an out-of-balance condition characterized by excursions of said tub in a direction generally parallel to said spin axis during said spin cycle;

an out-of-balance condition detecting system for interrupting said spinning means upon detection of said out-of-balance condition or upon said lid being open, said system comprising:

means for generating a fluidic pressure in response to said excursions of said tub;

actuating means fluidly coupled to said generating means and responsive to a predetermined level of said fluidic pressure for providing an actuating position corresponding to said out-of-balance condition, said actuating means comprising a respective enclosure in said cabinet, said actuating means further comprising biasing means and an actuating piston having an actuating rod cooperating in said enclosure such that said actuating rod moves in response to said predetermined level of fluidic pressure from a nonactuating position to reach said actuating position and moves back to said nonactuating position absent said predetermined level of fluidic pressure; and a switching assembly including a switch responsive to said actuating means to deenergize said spinning means upon said actuating means being in said actuating position and said switch being further responsive to said lid to deenergize said spinning means upon said lid being in an open position.

21. A washing machine in accordance with claim 20 wherein a constituent fluid for said fluidic pressure is air.

22. A washing machine in accordance with claim 21 wherein said generating means comprises a cylinder connected to said tub, said generating means further comprising a generating piston having an extension thereof connected to said cabinet, said generating piston and said cylinder reciprocating relative to one another in response to said excursions of said tub and constituting one generating unit to produce said fluidic pressure.

23. A washing machine in accordance with claim 22 wherein said one generating unit includes a suspension spring cooperating in said cylinder to provide support to said tub with respect to said cabinet.

24. A washing machine in accordance with claim 23 wherein said generating means comprises additional generating units substantially similar to said one generating unit, said additional generating units and said one generating unit being mutually spaced with respect to each other in a respective plane situated substantially parallel relative to the spin axis of said washer basket.

25. A washing machine in accordance with claim 22 wherein said switching assembly comprises a housing responsive to said actuating rod, said housing being adapted to move in response to said actuating rod from a first position corresponding to a balanced condition to a second position corresponding to said out-of-balance condition.

26. A washing machine in accordance with claim 25 wherein said housing is supported on guiding means for permitting slidable movement of said housing between said first and second positions.

27. A washing machine in accordance with claim 26 wherein said switching assembly further comprises respective biasing means operatively coupled to said housing for predeterminedly biasing said housing with respect to said actuating rod.

28. A washing machine in accordance with claim 27 wherein said switch includes a respective plunger.

29. A washing machine in accordance with claim 28 wherein said lid includes a projection positioned to depress said plunger to an energizing position whenever said housing is in said first position and said lid is in a closed position thereby energizing said spinning means.

30. A washing machine in accordance with claim 29 wherein said plunger is released to a deenergizing position whenever said housing moves from said first position to said second position thereby interrupting said out-of-balance condition.

31. A washing machine in accordance with claim 30 wherein said plunger is released to said deenergizing position whenever said lid is open while said housing is in said first position thereby deenergizing said spinning means.

32. A washing machine in accordance with claim 31 wherein said projection is positioned to impede movement of said housing from said second position to said first position whenever said lid is in said closed position.

33. A washing machine in accordance with claim 32 wherein said respective biasing means operatively coupled to said housing is a spring cooperating to move said housing from said second position to said first position upon said lid being open and upon said actuating rod returning to its nonactuating position absent said predetermined level of fluidic pressure.

34. A washing machine in accordance with claim 33 wherein respective opposite ends of said spring are connected to said housing and to said actuating rod respectively.

35. A washing machine in accordance with claim 21 wherein said switch is a magnetically actuated switch selected from the group consisting of a magnetic reed switch and a Hall effect switch.

36. A washing machine in accordance with claim 35 wherein said lid includes a respective lid magnet positioned to actuate said switch to a respective deenergizing position upon said lid being open thereby disabling said spinning means.

37. A washing machine in accordance with claim 36 wherein said actuating means comprises a respective enclosure in said cabinet, said actuating means further comprising biasing means and an actuating piston cooperating in said enclosure such that said actuating piston moves in response to said predetermined level of fluidic pressure from a nonactuating position to reach said actuating position and moves back to said nonactuating position absent said predetermined level of fluidic pressure.

38. A washing machine in accordance with claim 37 wherein said actuating piston includes a respective magnet disposed in one face of said actuating piston cooperating with said lid magnet to actuate said switch to a respective deenergizing position whenever said actuating piston is in its respective actuating position and said lid is in said closed position thereby interrupting said out-of-balance condition.

* * * * *